US005448232A

United States Patent [19]

Tyburski

[11] Patent Number: 5,448,232

[45] Date of Patent: Sep. 5, 1995

[54] ROADWAY SENSORS AND METHOD OF INSTALLING SAME

[75] Inventor: Robert M. Tyburski, Silver Spring, Md.

[73] Assignee: Mitron Systems Corporation, Columbia, Md.

[21] Appl. No.: 38,999

[22] Filed: Mar. 29, 1993

Related U.S. Application Data

[63] Continuation of Ser. No. 406,345, Sep. 13, 1989, abandoned, Continuation-in-part of Ser. No. 346,685, May 3, 1989, abandoned.

[51] Int. Cl.[6] ..... G08G 1/01

[52] U.S. Cl. ..... 340/933; 200/86 A; 310/800; 340/941

[58] Field of Search ..... 340/933, 939, 940, 666, 340/934, 941, 936; 200/86 R, 86 A; 310/330, 338, 800; 377/9; 73/146; 174/105 SC, 106 SC, 97, 102 SP; 404/6, 12, 71, 17, 32; 116/63 R; 364/436

[56] References Cited

U.S. PATENT DOCUMENTS

| | | | |
|---|---|---|---|
| 2,067,336 | 1/1937 | Paver . | |
| 2,403,277 | 7/1946 | Hall | 200/86 A |
| 3,750,127 | 7/1973 | Ayers et al. . | |
| 3,798,474 | 3/1974 | Cassand et al. | 310/800 X |
| 3,911,390 | 10/1975 | Myers . | |
| 4,216,403 | 8/1980 | Krempl et al. . | |
| 4,304,126 | 12/1981 | Yelke . | |
| 4,322,877 | 4/1982 | Taylor . | |
| 4,369,391 | 1/1983 | Micheron . | |
| 4,383,239 | 5/1983 | Robert | 340/933 |
| 4,443,730 | 4/1984 | Kitamura et al. . | |
| 4,585,970 | 4/1986 | Koal et al. | 310/800 X |
| 4,603,241 | 7/1986 | Nardi | 340/940 X |
| 4,629,925 | 12/1986 | Booth et al. . | |
| 4,634,917 | 1/1987 | Dvorsky et al. | 310/338 X |
| 4,688,306 | 8/1987 | Soni et al. . | |
| 4,695,988 | 9/1987 | Banno . | |
| 4,716,413 | 12/1987 | Haile | 200/86 A X |
| 4,794,295 | 12/1988 | Penneck et al. . | |
| 4,810,913 | 3/1989 | Beuducel et al. . | |
| 4,824,107 | 4/1989 | French . | |
| 4,839,480 | 6/1989 | Bickley | 200/86 A |
| 5,008,666 | 4/1991 | Gebert et al. | 340/933 |

FOREIGN PATENT DOCUMENTS

| | | | |
|---|---|---|---|
| 0287250 | 10/1988 | European Pat. Off. | 340/933 |
| 0387093 | 9/1990 | European Pat. Off. | 340/933 |
| 2042256 | 9/1980 | United Kingdom | 310/800 |

OTHER PUBLICATIONS

"A Review of Current Traffic Sensor Technology", Robert M. Tyburski, No Date Available.

Kynar Piezo Film, 1987.

*Primary Examiner*—Brent Swarthout

*Attorney, Agent, or Firm*—Jim Zegeer

[57] ABSTRACT

A linear roadway sensor in which a distributed weight member has a weight per unit length which is sufficient to maintain the sensor on the roadway and substantially immune to air effects generated by vehicular traffic on the roadway. A method of safely installing the sensor is to pivot one end at the edge of the roadway and then swing the sensor on an arc then allowing the weight to maintain the sensor on the roadway.

8 Claims, 5 Drawing Sheets

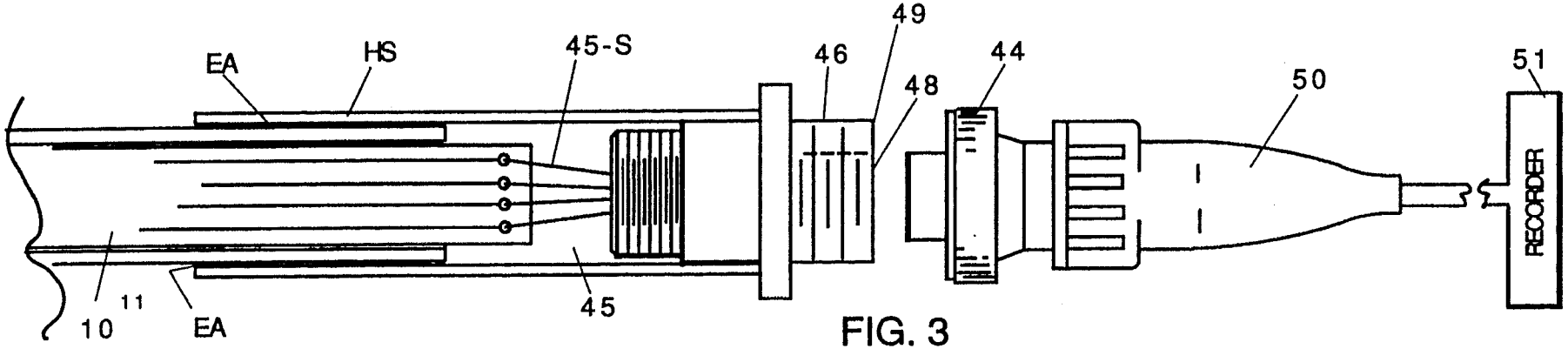
FIG. 3
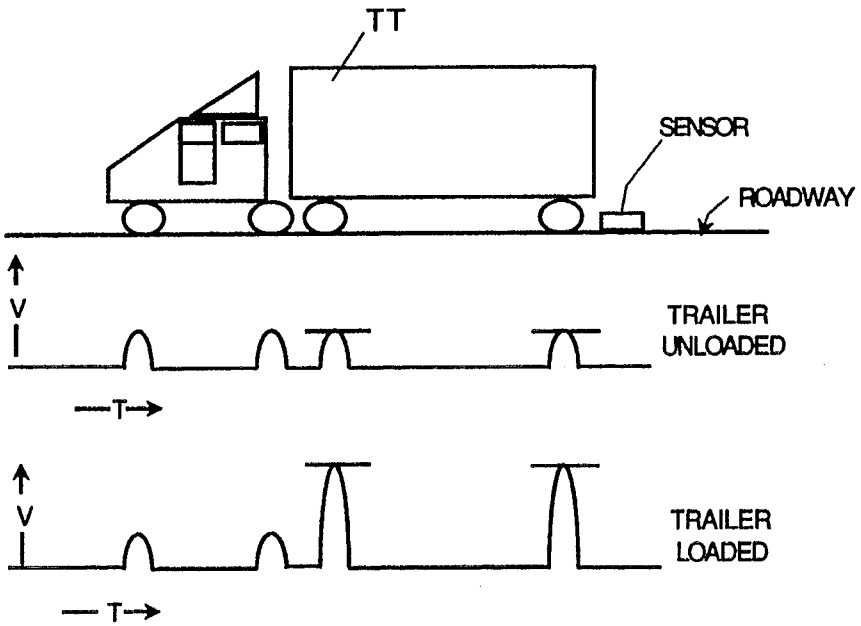
FIG 10A
FIG 10B
FIG 10C

ROADWAY SENSORS AND METHOD OF INSTALLING SAME

This is a continuation of application Ser. No. 07/406,345, filed Sep. 13, 1989, which was abandoned upon the filing hereof. which is a continuation-in-part of my application Ser. No. 07/346,685 filed May 3, 1989 entitled "ROADWAY SENSORS AND METHOD" and now abandoned.

BACKGROUND OF THE INVENTION AND DISCLOSURE STATEMENT:

Currently there are four major types of traffic or roadway sensors being employed to monitor vehicle traffic i.e., volume, speed, classification and weight-in-motion. The most common, the road tube, which generates an air pulse, is used for classification, volume and speed studies. The inductive loop is used for volume, speed and length classification studies. The capacitance mat is used for volume and weight-in-motion studies. Piezoelectric rod is used for volume, speed, classification and weight-in-motion studies. These sensors, and others, such as resistance strips, are used in conjunction with electronic traffic counters which establishes the monitoring parameters and stores results for generating traffic engineering reports.

A paper entitled "A Review of Current Traffic Sensor Technology" by the inventor hereof sets out and details the general constructions, methods of installation and advantages and disadvantages of these various systems and is incorporated herein by reference.

Roadway sensors which use the piezoelectric effect are known in the art as, for example, see Robert U.S. Pat. No. 4,383,239 wherein a piezoelectric sensor is isolated from roadway pressure waves by means of a system of roadway channel embedments. Surface mounting of switch plates or coaxial sensing cables to produce an electrical effect when subjected to pressure is disclosed in Myers U.S. Pat. No. 3,911,390. In the Myers patent, there is disclosed a multilane coaxial cable sensor in which individual sensor segments corresponding to lanes are connected to a recording unit. The traffic sensor is contained in a sealed envelope. A pair of spaced metallic plates are positioned in the envelope along the length thereof for nailing the sensor to the roadway. As an alternative, the sensor could be secured to the roadway by an adhesive material. Use of adhesive to secure roadway sensor switches to the pavement is also shown in Paver U.S. Pat. No. 2,067,336 wherein a rubber cement carried in a cloth tape secures a switch tube to the pavement. Adhesive tape has also been used for this purpose. The invention is applicable to all these various kind of roadway sensors where movement of the sensor caused by vehicle air turbulence can cause extraneous and/or ambiguous output signals.

The object of the present invention is to provide an improved roadway sensor, and method of attachment to the pavement of a roadway, particularly a roadway sensor fitted or equiped with a linear weight roadway sensor which is sufficient to itself maintain the sensor on road, and more particularly, to a flat roadway sensor which is fitted with a distributed linear weight of sufficient weight per unit length to maintain the flat sensor on the roadway at selected roadway speeds. For a high speed roadway where heavy trucks and the like travel at 75 mph a relatively heavy distributed weight is required, greater than one pound per foot and for speeds where the air flow effects are lower, a lower distributed weight is used.

A further object of the invention is to provide a roadway sensor, where if broken, (by being snagged by a dragging muffler, for example) is safer than prior art roadway sensors. A further object of the invention is to provide a safe method of installing roadway sensors. In a preferred embodiment of the invention, a roadway sensor is constructed of a thin flat piezo film strip having a system of sensing electrode patterns metallized on opposing surfaces thereof and signal conductors connected to the electrode patterns sandwiched or enveloped between two elastomeric strips with a flat linear weighting member embedded in or on one of the elastomeric strips so as to maintain the sensor on the roadway despite having loaded truck-trailer travel at high speeds generating a trailing air turbulence having the effect of sweeping the roadway. The weight member is uniformly distributed along the roadway portions of the sensor strip to maintain the sensor on the roadway and substantially immune to air effects generated by vehicular traffic on the roadway, a loaded truck-trailer traveling at high speeds, a flat malliable metal such as lead, strip having a weight greater than one pound per linear foot is required. For example, a lower speed and/or smaller lighter vehicles (which cause less air flow effects), a lower distributed weight can be used for example $\frac{1}{2}$ pound per linear foot of sensor.

The invention provides a low cost, rugged and roadway sensor which is compact, easy to install and can be safely installed in a few minutes by one person without stopping traffic. It has a low profile providing multilane output signals with one sensor. Moreover, it is portable and reuseable. It is capable of wide temperature range of operation and has reliable consistent output pulses. It can generate axle pulses and provide voltage signals with no external power supply being required. Moreover, if it is broken, it is safer than previous roadway sensors because the distributed weight in its preferred form holds the portions to the roadway so the sensor does not flap around with air currents caused by vehicles on the roadway.

While the invention is applicable to all forms of road sensors fixed to a roadway surface, in a preferred embodiment, piezoelectric film such as PVDF referred to above, is provided with separate discrete electrodes in predetermined metallized patterns for each lane of the roadway. An insulating coating or film is applied to the film and electrodes and an conductive electrostatic shield is applied or formed over the insulating coating. In the preferred embodiment, this piezoelectric film is then laminated and sealed between two elastomeric or rubber strips to form a sensor envelope. In a specific embodiment, a high weight linear weighting strip, such as $1\frac{3}{4}$ inch wide, $\frac{1}{8}$ inch thick lead is affixed to or incorporated into the sensor envelope or otherwise incorporated in the construction to maintain the sensor in contact with the roadway along the length thereof so that only compressive loading caused by vehicle wheels cause voltage signals to be generated in the electrodes on the piezoelectric film.

Moreover, static electricity generated by movement of a body in air, for example, which can create false signals and/or ambiguous signals, can be discharged into conductive elements, which can constitute at least a part of the high weight linear weighting strip and serve as an electrostatic shield which is incorporated in the sensor.

In one embodiment, the conductive electrostatic shield is a foil of mallable metal such as lead.

As disclosed in my above-identified application, the manner of installation of the sensor to the roadway is critical to its operation. At high speeds, such as on interstate highways, vehicular traffic, heavy trucks, for example, can create air flow and negative pressure effects of sufficient force on the roadway sensor to lift and move it and create ambiguous signals. This form of error or ambigupis signal can be generated in other varieties of roadway sensors. The uniform adherence of the flat envelope to the roadway aids in avoiding stretching along the length of the piezoelectric film. In one preferred embodiment, a PVDF piezoelectric film strip with metallized electrode patterns and signal conductors connected thereto is laminated between two pieces of flat roadway grade rubber or plastic strips with a linear weight member in the lower rubber strip. For example, a $1\frac{3}{4}$ inch wide, $\frac{1}{8}$ inch thick lead strip about 28 feet long weighs about 32 pounds. A thin piezoelectric film strip of the type disclosed in my above application for a dual lane roadway is preferred. For lower speed highways, a lower weight can be used. For example, for 35 mph a lead strip 1/16 inch thick and $1\frac{3}{4}$ inch wide (greater than one-half pound per linear foot) could be used. Steel lead shot sand and liquids could also be used.

Electrical connections to the metallizations can be made in a number of ways, but in the preferred embodiment, separate electrical connections are made to each lane metallization and discrete wires or conductors carry the signal voltages which are generated due to compression stressing of the piezoelectric film. These discrete wires or conductors can be fine multistrand insulated wires individually connected to each metallization or conductors printed on a common non-conductive, inert substrate which is discrete or non-piezoelectric with respect to the piezoelectric film. For single lane roadways, the piezoelectric film strip can be made wider and the signal conductor leads printed on the film with the metallization of the sensor electrodes.

The pattern of electrodes for the piezoelectric film can be designed to detect the number of tires and axles for a given vehicle. A particularly useful application of the invention is in connection with intersection data capture systems in which multiple lane roadways meet at intersections wherein vehicles traversing the different lanes can turn in different directions at the intersection and it is desired to know the various turnings and vehicle traffic in the different roadways of the multilane highways.

In the preferred embodiment, the piezoelectric film strip and its electrode metallizations have an insulative conformal coating thereon to prevent moisture or other material from adversely affecting operation. The electrostatic shield can be a conductive coating applied at least to the upper external surfaces of the conformed coating, and/or a separate or discrete conductive grid sealed in the envelope and/or as conductive material, such as carbon granules embedded in the rubber or plastic envelope elements. As noted above, in one embodiment the electrostatic shield is a strip of lead foil weight to cause an adherence of the sensor to the roadway when heavy vehicles, such as trucks, create trailing turbulences and air currents tending to lift and drag the sensor. The weight distributed along the roadway portion of the sensor prevents this and thus prevents stretching along the length (axial stretch) of the sensor material. In a further embodiment, the electrostatic shield is a conductive epoxy which eliminates voids and secures the upper outer roadway rubber layer of the outer protective envelope to the insulating conformal coating. Where the electrostatic shield is within the envelope it is electrically connected by a separate conductor to earth ground, as distinct from the electrical ground or return of the piezoelectric sensor elements.

In a further embodiment, the piezoelectric film sensor is positioned over a flat lead strip and a latex layer is between the lead layer and the piezoelectric film. This layered assembly is enclosed in an envelope.

BRIEF DESCRIPTION OF THE DRAWINGS

The above and other objects, advantages and features of the invention will be more apparent when considered with the following specification and accompanying drawings wherein:

FIG. 3 is a top plan view thereof showing the electrical connection to a roadway counter system.

FIG. 10*a* illustrates a tractor-trailer truck traveling over the roadway sensor of this invention, FIG. 10*b* illustrates the response of the sensor to an unloaded trailer traversing same, and FIG. 10*c* illustrates the response of the sensor to a loaded trailer traversing same.

DETAILED DESCRIPTION OF THE INVENTION

Figure 1A:
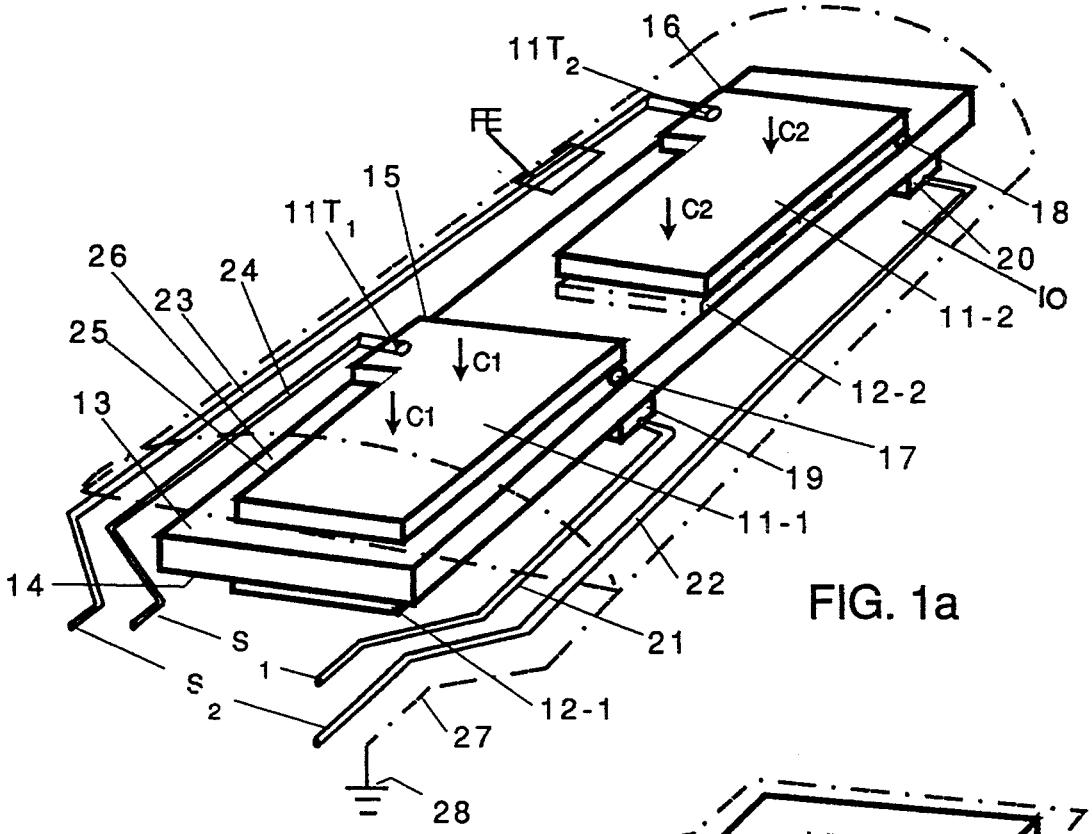
FIG. 1*a* is an isometric plan view of a piezoelectric film strip for a dual lane highway showing one form of electrical connections to the sensor electrodes.
Figure 1B:
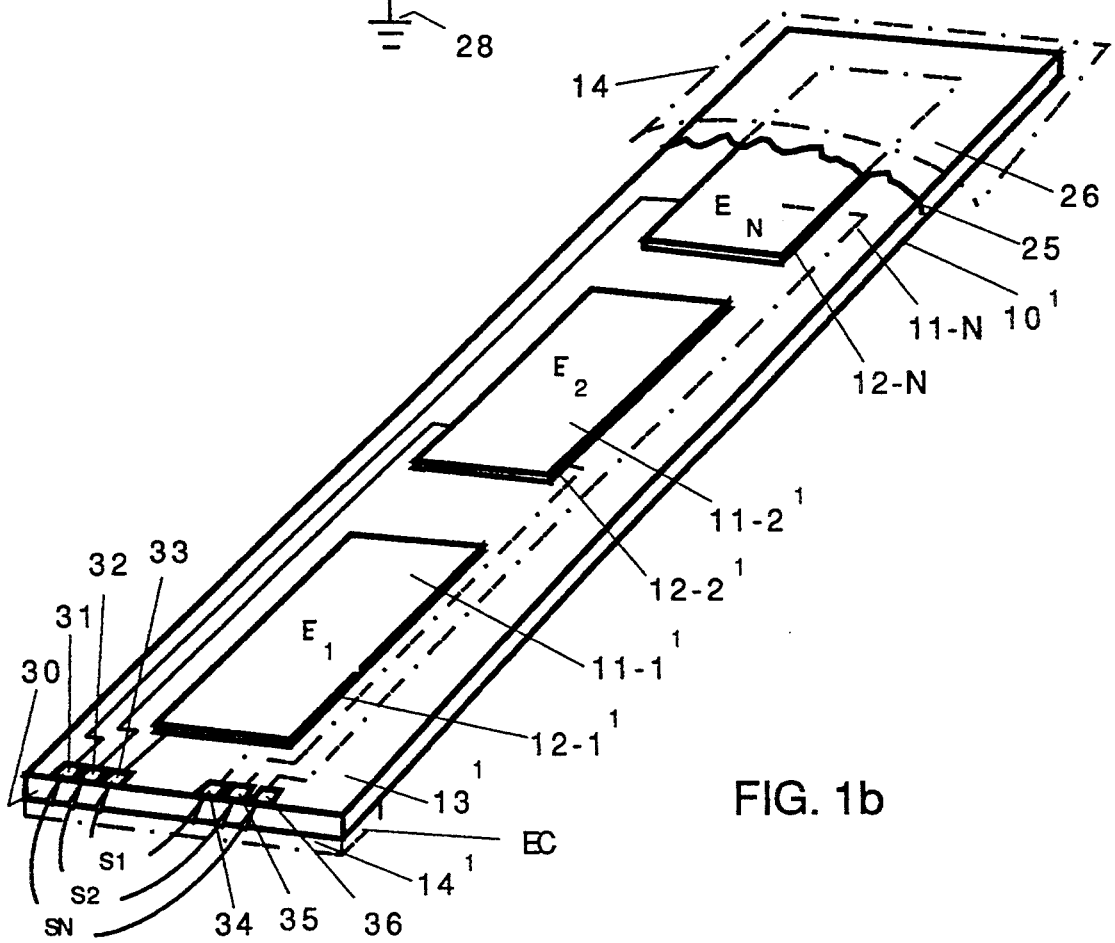
FIG. 1*b* is a similar view of a further form of electrical connections to the sensor electrodes.

Referring first to FIGS. 1*a* and 1*b*, a very thin piezoelectric film or piezo film 10 is flexible with upper electrode array 11-1, 11-2, and lower electrode array 12-1, 12-2, which are metallized areas on the opposing surfaces 13, 14, respectively, of piezo film 10 and corresponds to the span of each roadway lane to be monitored. Piezo film 10 is a film ranging in thickness from a few micrometers upward, reference being made to the "KYNAR TM" "Piezo Film Technical Manual" published (1987) by Pennwalt and identified above. In the accompanying drawings, the film thickness and metallizations thereon are greatly exaggerated to show physical construction. Typically, the film 10 can have a width of about one half to three inches, for example, and a length for spanning all of the lanes of the roadway with corresponding lane metallizations.

Electrical connections are made to the electrode metallizations on the upper surfaces and by means of electrode Tabs 11T1, 11T2, which include conductive eyelets 15 and 16 for metallized electrode areas 11-1 and 11-2, and on the lower surfaces by conductive eyelets 17 and 18 for connecting metallization tabs 19 and 20 to insulated conductors 21 and 22, respectively. Eyelets 15 and 16 connect the upper electrodes to insulated conductors 23 and 24 respectively, and any compressive load in the direction C1 or C2 will produce a voltage signal S1 between conductors 21 and 24 and a voltage signal S2 between conductors 22, 23. In the case of the more remote sensing electrode pair 11-2 and 12-2, a field effect device (not shown) may be connected to amplify the signals from that pair of metallizations. The entire assembly may be protected from moisture by an insulating coating 25.

Vehicle electrical ignitions and other high intensity electrostatic fields can induce voltages in the piezoelectric film strip and to avoid this effect, an electrostatic shield 26 is applied over at least over the upper surface and, if desired, over the underside. This electrostatic shield is connected by a separate individual conductor 27 for connection to earth ground 28 so that any electrostatic fields which could tend to induce noise in the metallization electrodes are shielded and grounded separately by the electrostatic shield. The electrostatic shield is shielded from the electrodes and conductors by the conformal moisture-proof insulating coating 25. In one embodiment shown in FIG. 4 of the invention, the electrostatic shield 26' is a heavy metal foil, such as lead, to add weight to the sensor to constitute a linear weight distributed along the sensor and either alone or in conjunction with a further weight strip 50 the total distributed weight per unit length is sufficient to maintain the sensor on the roadway and make it substantially immune to lifting from the roadway due to air flow effects and turbulences of traveling at high speeds of, for example, 75 mph and avoids erroneous or ambiguous signals being generated.

Even if the sensor strip, whether it be a piezoelectric film or any one of the prior art sensors referred to earlier herein (inductive, precumulative, capacitance, resistance, etc.) is snagged or broken by vehicular traffic it will still hug the road and not be as dangerous to moving traffic and pedestrians as a roadway sensor not equiped with this invention.

As shown in FIG. 1*b*, the piezo film strip 10' is made wide enough so that the sensing electrodes E1, E2 . . . EN may be provided with integral metallization conductors on both the upper and lower surfaces 13', 14' of the piezo film strip and conveyed to one lateral edge 30 where metallization pads 31, 32, 33, 34, 35, and 36 are formed for securement by means of conductive eyelets to conductors leading to a recording device or a counter. Alternatively, a stiffener or rigid edge connector member EC may be secured to the end 30 with the metallization formed therein so that the end of the strip may be plugged into a conventional strip connector (not shown) for leading to the counter.

Figure 2:
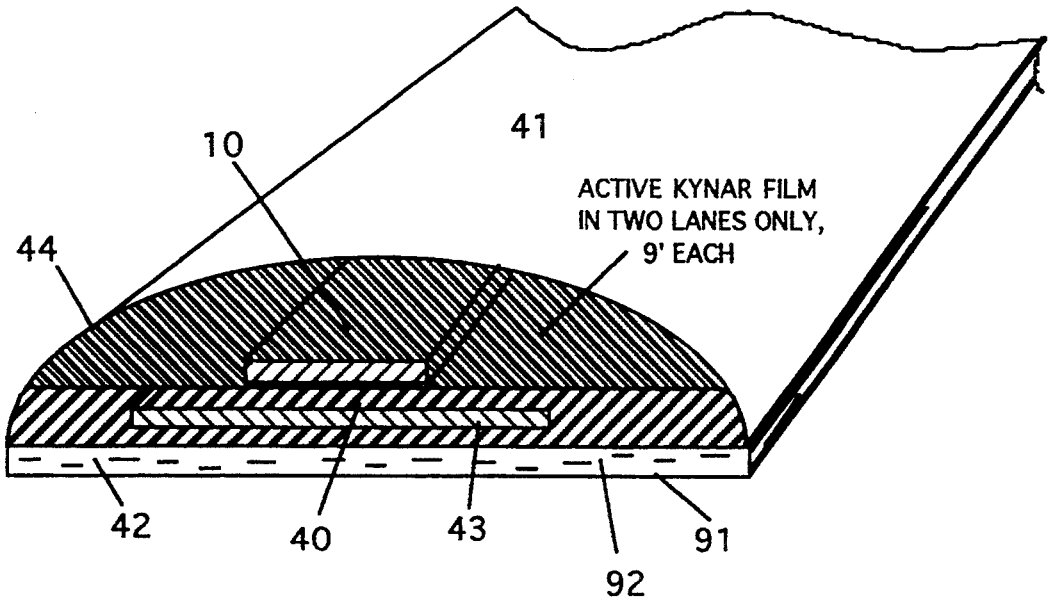
FIG. 2 is a cross-sectional view of a roadway sensor incorporating the invention.

Referring now to FIG. 2 which is a cross-sectional isometric view of a roadway sensor incorporating the invention, the piezoelectric film strip and electrode with metallized electrode and conductors 40, of the type shown in FIG. 1*a* or 1*b* is encased or enclosed in an elastomeric or rubber molded hermetic enclosure 41. Enclosure 41 includes a lower rubber portion 42 which has embedded therein a flat, distributed weight metal or member 43 which runs the complete length of the sensor and thereby provides a uniformly distributed linear weight for maintaining the sensor on the roadway. In this embodiment, the upper strip 44 of the molded rubber enclosure 41 is curved or shaped such that the vehicle's air stream is used in a positive way to minimize the movement of the sensor in the longitudinal direction and further prevent stretch in the piezo film 10, 10', etc. This embodiment has a height of about ¼ inch, about half of which is constituted by the thickness of the weight member 43.

The top plan view of FIG. 3 shows the electrical connection of the conductors connected to the electrodes to a coupling unit which includes a strain relief member. In this view, each of the conductors carrying signal currents is coupled via a shielded wire 45S to an electrical connector 50. A heat shrinkable tubular member HS is shrunk and secured by means of an epoxy adhesive EA to the external surfaces of the envelope, the heat shrinking tubing conforming to the shape of the envelope and in conjunction with the epoxy, forming a rugged water-tight connection. Other forms of seal/securement may be used. The area indicated by the numeral 45 may be filled with a flexible epoxy to serve as a strain relief. Shielded wires 45S couple the signals to pins 49 of the connector. The outer tube of the connector has a threaded coupling 46 so that the female connector portion 48 mates with the male projection pins 49 (in connector 46). A corresponding strain relief portion 50 is provided on the male connector element 44 and leads to the recorder 51. The recorder 51 may be of the type shown in my U.S. Pat. No. 4,258,430.

Figure 4:
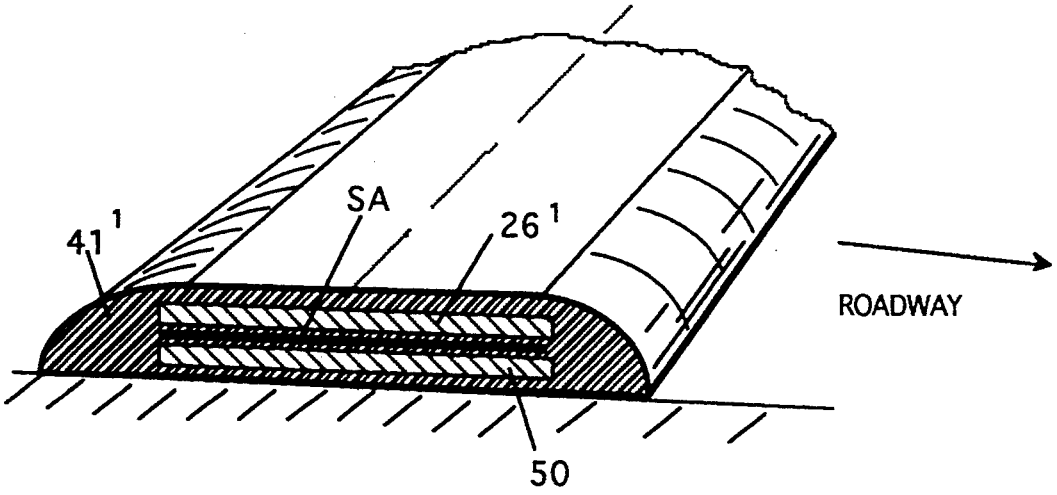
FIG. 4 is a sectional isometric view illustrating one preferred embodiment of the invention wherein the linear weight in part constitutes an electrostatic shield.

FIG. 4 is a sectional isometric view showing an outer molded enclosure 41' in which the flat piezoelectric sensor assembly SA such as shown in FIGS. 1*a* and 1*b*, incorporates a first lead foil weight member 26', which is thin enough to transmit the vehicle wheel loadings to the piezo strip, and which is adapted to serve as the electrostatic shield for the sensor assembly SA, and a heavier lower lead metal layer 50. These two lead layers constitute a linear weight distributed along the sensor such that the total distributed weight per unit length is sufficient to maintain the sensor on the roadway and make it substantially immune to lifting from the roadway due to air flow effects caused by vehicular traffic on the roadway. With the flat configuration illustrated in FIG. 4, the surface roadway air currents are insufficient to cause a lifting or movement due to these effects of the sensor and hence reduces or eliminates any erroneous or ambiguous signals. Should the roadway sensor be broken, it still lay safely on the roadway and does not dangerously flap and fly around as vehicular traffic moves by.

Figure 5:
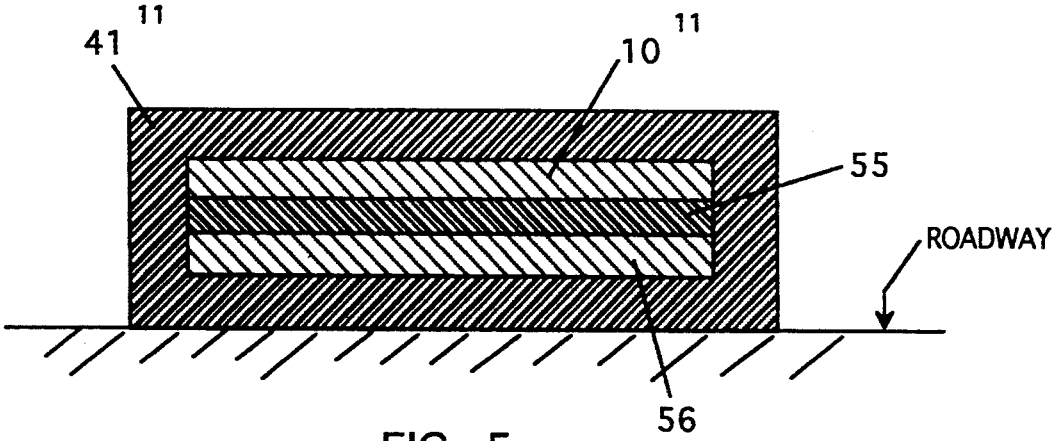
FIG. 5 is a sectional view illustrating a further preferred embodiment which has a latex base under the piezoelectric film between and over a flat lead metal weight element, distributed along the length of the film and in a protective envelope.

In the arrangement shown in FIG. 5, the piezo film strip assembly 10'' has a relatively hard under-surface constituted by the lead metal layer 56 therebeneath it so that the signals induced by the loading or weight of vehicles traveling thereover are diminished slightly.

So that the "KYNAR TM" can stretch locally due to compression loading, a latex layer 55 positioned beneath the piezoelectric film strip causes the signals to be greatly enhanced and this is believed to be due to the local stretching of the piezoelectric film strip due to the compression loading of vehicles traversing thereover. When added, the signal-to-noise ratio increases greatly. Thus, the envelope 41' contains as an upper layer the piezoelectric film strip 10" as illustrated in FIG. 16*b* with a electrostatic screen thereover and a latex layer 55 beneath the piezoelectric sensor strip 10". The lead layer 56 provides the distributed weight according to the present invention. In the embodiment shown in FIG. 5, for a two-lane roadway, the lead strip is approximately ⅛ inch thick, 1¾ inches wide and approximately 28 feet long and has a weight of approximately 32 pounds. This provides a weight per unit per foot of over one pound. For roadways where it is known that the traffic speeds will be substantially less, less distributed weight can be employed.

Figure 6:
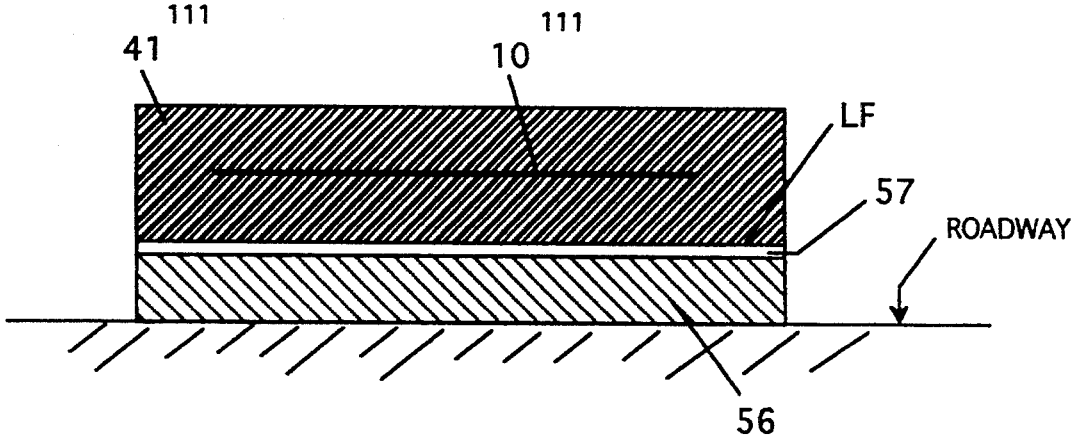
FIG. 6 is a sectional view illustrating a further preferred embodiment wherein the weight is outside the envelope and secured to the underside by a double-faced adhesive.

In the embodiment shown in FIG. 6, the envelope 41''' encases a piezoelectric sensor strip assembly 10''' with the electrostatic shield thereon as illustrated in FIG. 1*b*, and a lead strip 56' which has been secured to the lower face LF of envelope 41''' by a double-faced adhesive layer 57. Double-faced adhesive layer 57 is similar to the double-faced adhesive layer 42 shown in FIG. 2 and described in greater detail in my above-identified application. Video observations thereof confirm that there is no movement and electrical signals are more faithful and less ambiguous to the observed traffic.

Figure 7:
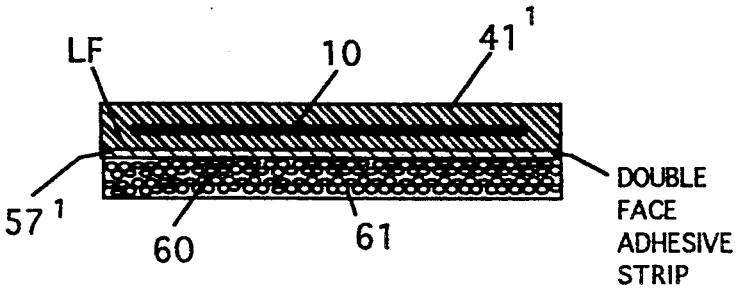
FIG. 7 illustrates a further preferred embodiment of the invention wherein steel or lead shot or sand, etc. is contained in a separate envelope.
Figure 8:
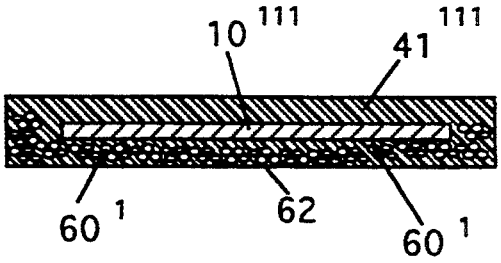
FIG. 8 illustrates a further preferred embodiment wherein the weight is shot embedded in a thick lower layer of the envelope, and FIGS. 9*a* and 9*b* diagrammatically illustrate a preferred method of installing the weighted sensor on an active roadway.

Referring now to FIGS. 7 and 8, FIG. 7 discloses a sensor unit in which the envelope 41' encases a sensor strip assembly 10' similar to as described in connection with FIG. 6. In this case, steel or lead shot 60 is encased in a separate envelope 61 which may be formed as a part of or secured to the lower face LF of envelope 41' by a double-Faced adhesive layer 57'. The steel or lead shot can be sand, or any heavy fluent material and including liquid such as water having the prescribed weight characteristics. However, the key requirement is that the weight have the characteristic of being sufficient per unit length without increasing the overall height of the strip and reducing its flatness. In a preferred embodiment, the roadway strip is less than ⅜ inch high and, in a typical embodiment, is approximately ¼ inch thick, or from the surface engaging the roadway to the top surface thereof.

In FIG. 8, the weight is in the form of steel or lead shot which has been embodied in the lower elastomeric layer 62. In this case rupturing of the weight envelope may release the shot, sand, or liquid, which is still softer that conventional or prior art construction since the envelope is light and flexible.

As shown in FIG. 10, a trailer truck TT has four-wheel axles and, as illustrated in the waveform trace of the output of the sensor, each axle produces a pulse. It should be noted that the higher the weight on the wheel and hence the sensor, the larger the pulse and, the higher the speed, more energy is transferred to the sensor to create a larger pulse. Thus, as indicated in FIG. 10, the front wheels of the tractor itself produces relatively smaller pulses than the rear wheels of a loaded trailer which produces substantially larger output pulses. This information can be used by the computer to analyze the vehicular traffic on the roadway. Cars, for example, will have substantially smaller pulses, and the unit can even discriminate cars with front wheel drive as opposed to cars with rear wheel drive.

METHOD OF INSTALLING

Figure 9A:
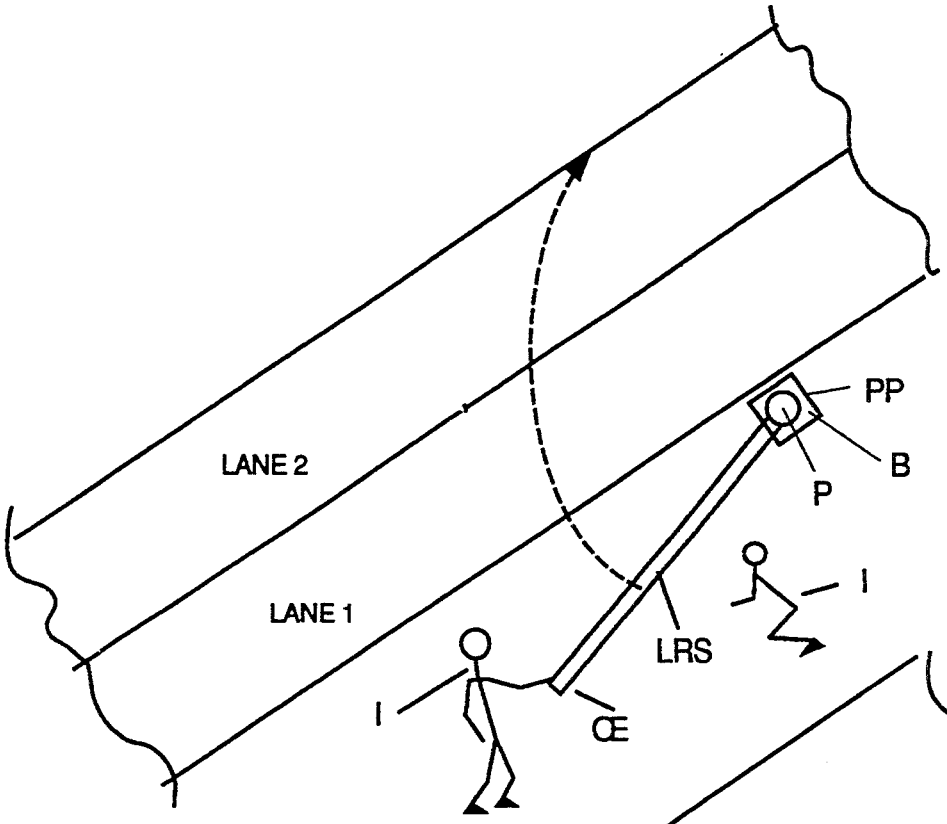
Figure 9B:
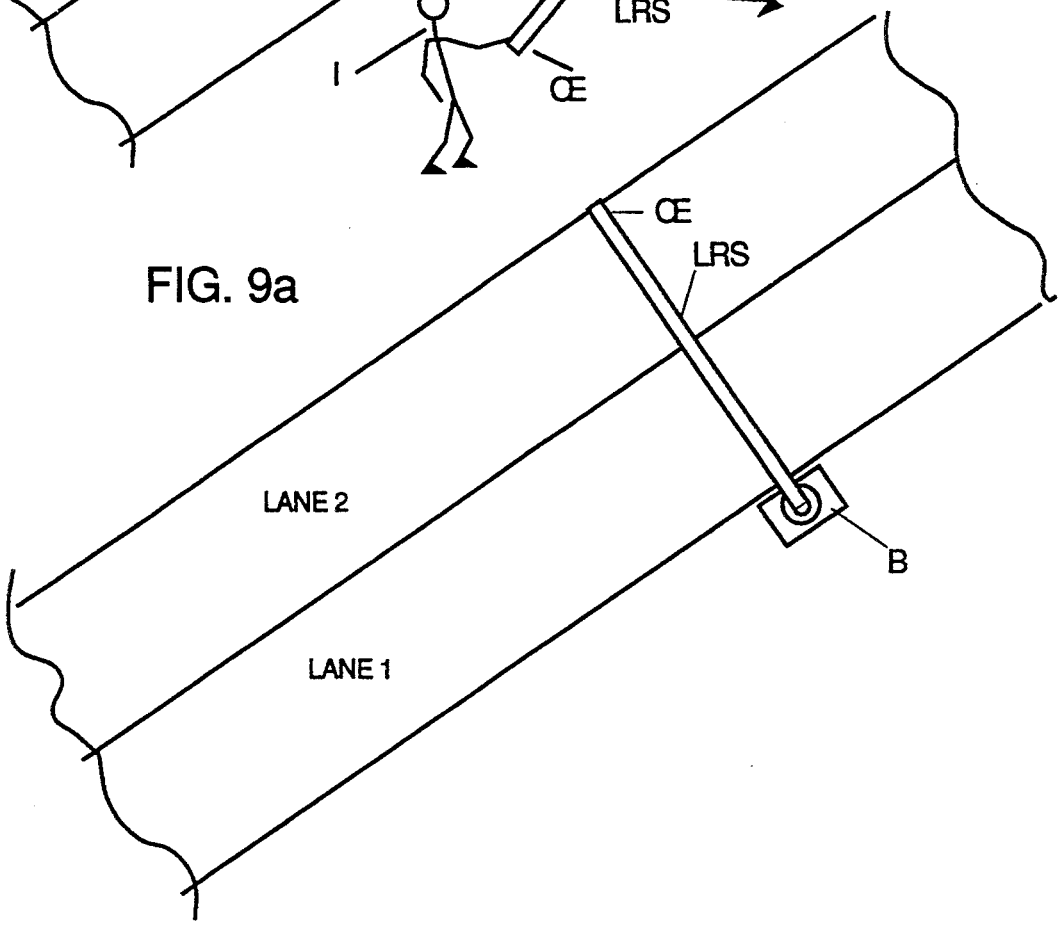

The novel method of installing the sensor, according to the invention, on the roadway is illustrated in FIGS. 9*a* and 9*b*. This provides a method of safely and quickly installing this linear roadway sensor LRS on a roadway. A pivot pad PP is attached to one end of the linear roadway sensor LRS with a pivot P secured to the pivot pad PP which is secured to the roadway. Pivot pad PP is constituted by a base B which may be nailed to the edge of the road, and a pivot P secured to one end of the envelope of sensor LRS. The pivot secured to one end of the linear roadway sensor LRS is freely pivotted thereon and the opposite end OE is grabbed by the installer I. Installer I looks in the direction of travel of oncoming vehicles on the roadway lanes 1 and 2 and waits for a clearing and when a clearing appears, the installer I runs on an arc holding the end OE of linear roadway sensor LRS and swings it on an arc across the roadway to where it is substantially orthogonal to lanes 1 and 2. The installer I simply releases the end OE and allows the linearly distributed weight to cause the sensor to maintain direct contact with the roadway. The roadway sensor LRS will remain stationary because of the weighting and roadway currents and air flow effects, positive and/or negative, do not affect the position of the sensor on the roadway. However, to avoid theft and the like problems, it is desirable to secure the end OE by other standard securement means to the roadway such as a clamp or the like (not shown) by the installer I, who, as shown in FIG. 9*b* is kneeling by the side of the roadway waiting for a clearance in vehicle traffic to secure the end OE to the roadway.

In addition, the envelope may be secured to the roadway by means of a double-faced adhesive tape as disclosed in my above-identified application. This arrangement can be utilized where it is desired to provide quick installation of the roadway sensor on non-porous roadways and is adapted for reuse. In this case, an example of a double-faced adhesive tape useful with this invention is the 3M Company NPE2546 double-faced adhesive tape. This tape contains a nylon scrim which has a loose weave or mesh with approximately ⅛" between interstices or intersections to thereby permit the adhesive to be on both sides of the scrim to be generally integral or one.

While the preferred embodiments of the invention have been described, it is to be understood that the disclosure is for the purpose of illustration and to enable those skilled in the art to practice the invention, and it is intended that other embodiments and modifications of the invention can be made without departing from the spirit and scope of the invention as set forth in the appended claims.

What is claimed is:

1. In a linear roadway vehicle sensor for sensing vehicular traffic thereover, the improvement comprising: linear weight means distributed along said sensor, said linear weight means having a weight per unit length sufficient to maintain said sensor on said road and substantially immune to lifting from the roadway because of air flow effects and turbulence caused by vehicles, and means securing said linear weight means to said linear roadway sensor wherein said linear weight means is fluent and selected from shot, sand or a liquid.

2. In a linear roadway sensor for sensing vehicular traffic and which is substantially immune to lifting from the roadway because of air flow turbulence caused by vehicles traveling at high speeds thereover, the improvement comprising: linear weight means distributed along said sensor, said linear weight means having a weight of at least one pound per linear foot, and means securing said linear weight means to said linear roadway sensor along the length thereof wherein said linear weight means is comprised of a material selected from metal shot, sand or fluid.

3. In a flat piezoelectric roadway sensor having a thin flat piezoelectric film strip, a system of sensing electrodes on opposing surfaces of said piezoelectric film strip and, conductor means for connecting said sensing electrodes to a utilization device, an elastomeric envelope surrounding said film, electrodes and conductor means, a latex layer below said piezoelectric film strip whereby said piezoelectric film strip is sensitive to the load pressure of vehicle tires thereon to proportionately generate voltage signals corresponding to the wheels of vehicles thereon, and linear weight means for maintaining said envelope on a roadway and wherein said envelope and said thin flat piezoelectric film strip has a length sufficient to cross at least two roadways and a set of said electrodes for each roadway, and said weight means for maintaining said envelope on said roadway is a linear weight distributed substantially uniformly along the length thereof.

4. The flat piezoelectric roadway sensor defined in claim 3 wherein said linear weight is one or more flat lead metal strips.

5. In a flat piezoelectric roadway sensor having a thin flat piezoelectric film strip, a system of sensing electrodes on opposing surfaces of said piezoelectric film strip and, conductor means for connecting said sensing electrodes to a utilization device, an elastomeric envelope surrounding said film, electrodes and conductor means, a latex layer below said piezoelectric film strip whereby said piezoelectric film strip is sensitive to the load pressure of vehicle tires thereon to proportionately generate voltage signals corresponding to the wheels of vehicles thereon, means for maintaining said envelope on a roadway, wherein said envelope and said thin flat piezoelectric film strip has a length sufficient to cross at least two roadways and a set of said electrodes for each roadway, and said means for maintaining said envelope on said roadway is a linear weight distributed substantially uniformly along the length thereof and wherein said linear weight is constituted by at least a pair of lead metal strips, at least one of said lead strips is flexible in said envelope and positioned above said flat piezoelectric film strip to serve as an electrostatic shield.

6. In a linear roadway vehicle sensor for sensing vehicular traffic thereover, the improvement comprising, a flexible carrier member for said sensor and a linear lead weight member distributed along the length of said carrier and means for securing said sensor to said carrier, means for securing the lead weight member within a recess in said carrier member, said linear lead weight member being malleable and non-resilient and having a weight per unit length such that said linear lead weight member is at least one pound per linear foot and is sufficient to maintain said sensor on said roadway and substantially immune to lifting from the roadway because of air flow effects and turbulence caused by vehicles and causing said carrier to hug the roadway surface.

7. A linear roadway sensor for sensing vehicular traffic and a carrier for said sensor which is substantially immune to lifting from the roadway because of air flow turbulence caused by vehicles traveling at high speeds thereover, said carrier being a flexible carrier member for said linear roadway sensor, a linear lead weight distributed along said carrier member, said carrier including means for securing the lead weight within a recess in said carrier member, said roadway sensor including said linear lead weight having a weight of at least one pound per linear foot and at least sufficient to render said flexible carrier member substantially immune to air effects generated by vehicular traffic on the roadway, and to cause the carrier to hug the roadway surface and not be dangerous to moving traffic or pedestrians even if snagged or broken by vehicular traffic.

8. A linear roadway vehicle sensor for sensing vehicular traffic, comprising, a linear sensor for sensing vehicle pressure, and a carrier therefor, the improvement wherein said carrier is comprised of a flexible carrier member and a linear lead weight member, said carrier including means for securing said lead weight member within a recess in said carrier, said carrier member, linear lead weight member and linear sensor being flexible and having a weight per unit length such that said sensor, flexible carrier member and linear lead weight member are sufficient to maintain said sensor on said roadway and substantially immune to bouncing and lifting from the roadway because of air flow effects and turbulence caused by vehicles.

* * * * *